US005149612A

United States Patent [19]

Langlois et al.

[11] Patent Number: 5,149,612

[45] Date of Patent: Sep. 22, 1992

[54] FABRICATION OF ELECTROPHOTOGRAPHIC IMAGING MEMBERS

[75] Inventors: Edouard E. Langlois, Rochester, N.Y.; Kathryn T. Kehoe; Warren R. Smith, both of Oklahoma City, Okla.; Mark Muscato, Yukon, Okla.; Barbara D. Ceglinski, Oklahoma City, Okla.; Alan C. Kirchoff, Webster, N.Y.; Robert F. Dunham; Michael D. Stair, both of Yukon, Okla.

[73] Assignee: Xerox Corporation, Stamford, Conn.

[21] Appl. No.: 548,310

[22] Filed: Jul. 2, 1990

[51] Int. Cl.[5] ..... G03G 5/047

[52] U.S. Cl. ..... 430/132; 427/402

[58] Field of Search ..... 430/58, 59, 96, 132; 427/402

[56] References Cited

U.S. PATENT DOCUMENTS

| | | | |
|---|---|---|---|
| 3,888,465 | 6/1975 | Terwilliger et al. | 259/4 |
| 4,018,602 | 4/1977 | Chu | 96/1.5 |
| 4,106,934 | 8/1978 | Turnblom | 96/1.5 R |
| 4,264,695 | 4/1981 | Kozima et al. | 430/58 |
| 4,504,564 | 3/1985 | Pai et al. | 430/132 |
| 4,543,314 | 9/1985 | Maxwell | 430/134 |
| 4,725,518 | 2/1988 | Carmichael et al. | 430/132 |
| 4,874,682 | 10/1989 | Scott et al. | 430/59 |

*Primary Examiner*—John Goodrow
*Attorney, Agent, or Firm*—Peter H. Kondo

[57] ABSTRACT

Processes and apparatus for fabricating an electrophotographic imaging member in which a web coated with a charge generation layer is coated with a charge transport layer comprising a dopant, the improvement comprising detecting the change in dopant concentration required, determining the amount of highly doped charge transport composition and amount of undoped or lowly doped charge transport composition required to achieve the change in dopant concentration, feeding the determined amounts of highly doped charge transport composition and undoped or lowly doped charge transport composition into a mixing zone, rapidly mixing the amounts of highly doped charge transport composition and undoped or lowly doped charge transport composition to form a uniformly doped charge transport composition, and applying the uniformly doped charge transport composition to the charge generation layer.

15 Claims, 2 Drawing Sheets

FABRICATION OF ELECTROPHOTOGRAPHIC IMAGING MEMBERS

BACKGROUND OF THE INVENTION

This invention relates in general to electrophotographic imaging members and more specifically, to a process and apparatus for fabricating the electrophotographic imaging members.

In the art of xerography, a xerographic plate containing a photoconductive insulating layer is imaged by first uniformly electrostatically charging its surface. The plate is then exposed to a pattern of activating electromagnetic radiation such as light, which selectively dissipates the charge in the illuminated areas of the photoconductive insulator while leaving behind an electrostatic latent image in the non-illuminated areas. This electrostatic latent image may then be developed to form a visible image by depositing finely divided electroscopic marking particles on the surface of the photoconductive insulating layer.

A photoconductive layer for use in xerography may be a homogeneous layer of a single material such as vitreous selenium or it may be a composite layer containing a photoconductor and another material. One type of composite photoconductive layer used in xerography is illustrated in U.S. Pat. No. 4,265,990 in which a photosensitive member having at least two electrically operative layers is described. One layer comprises a photoconductive layer which is capable of photogenerating holes and injecting the photogenerated holes into a contiguous charge transport layer. Generally, where the two electrically operative layers are supported on a conductive layer with the photoconductive layer capable of photogenerating holes and injecting photogenerated holes sandwiched between the contiguous charge transport layer and the supporting conductive layer, the outer surface of the charge transport layer is normally charged with a uniform charge of a negative polarity and the supporting electrode is utilized as an anode. Obviously, the supporting electrode may also function as an anode when the charge transport layer is sandwiched between the electrode and a photoconductive layer which is capable of photogenerating electrons and injecting the photogenerated electrons into the charge transport layer. The charge transport layer in this embodiment, of course, must be capable of supporting the injection of photogenerated electrons from the photoconductive layer and transporting the electrons through the charge transport layer.

Various combinations of materials for charge generating layers and charge transport layers have been investigated. For example, the photosensitive member described in U.S. Pat. No. 4,265,990 utilizes a charge generating layer in contiguous contact with a charge transport layer comprising a polycarbonate resin and one or more of certain aromatic amine compound. Various generating layers comprising photoconductive layers exhibiting the capability of photogeneration of holes and injection of the holes into a charge transport layer have also been investigated. Typical photoconductive materials utilized in the generating layer include amorphous selenium, trigonal selenium, and selenium alloys such as selenium-tellurium, selenium-tellurium-arsenic, selenium-arsenic, and mixtures thereof. The charge generation layer may comprise a homogeneous photoconductive material or particulate photoconductive material dispersed in a binder. Other examples of homogeneous and binder charge generation layer are disclosed in U.S. Pat. No. 4,265,990. Additional examples of binder materials such as poly(hydroxyether) resins are taught in U.S. Pat. No. 4,439,507. The disclosures of the aforesaid U.S. Pat. No. 4,265,990 and U.S. Pat. No. 4,439,507 are incorporated herein in their entirety. Photosensitive members having at least two electrically operative layers as disclosed above in, for example, U.S. Pat. No. 4,265,990 provide excellent images when charged with a uniform negative electrostatic charge, exposed to a light image and thereafter developed with finely developed electroscopic marking particles. However, when the charge transport layer comprises a film forming resin and one or more of certain diamine compound, difficulties have been encountered with these photosensitive members when they are used in high volume, high speed copiers, duplicators and printers. For example, it has been found that when certain charge transport layers comprise a film forming resin and an aromatic amine compound, the dark decay characteristics are unpredictable from one production batch to another. Dark decay ($V_{DDP}$) is defined as the loss of charge on a photoreceptor in the dark after uniform charging. This unpredictability characteristic is highly undesirable, particularly for high volume, high speed copiers, duplicators and printers which require precise, stable, and predictable photoreceptor operating ranges. Erratic variations in dark decay rate can be unacceptable or at, the very least, require expensive and sophisticated control systems or trained repair persons to alter machine operating parameters such as charging potentials, toner concentration and the like to compensate for different photoreceptor dark decay rates. Failure to adequately compensate for dark decay rate differences when replacing photoreceptors in a machine can result in copies of poor copy quality. Moreover, such variations in dark decay rate prevent achievement of optimized dark decay properties.

Similarly, photoreceptors utilizing charge transport layers comprising a film forming resin and one or more of certain aromatic amine compounds also exhibit erratic variations in background potential ($V_{BG}$) from one production batch to another. Background potential is defined as the potential in the background or light struck areas of a photosensitive member after exposure to a pattern of activating electromagnetic radiation such as light. Unpredictable variations in background potential can adversely affect copy quality, especially in complex, high volume, high speed copiers, duplicators and printers which by their very nature require photoreceptor properties to meet precise narrow operating windows. Thus, like photoreceptors that exhibit batch to batch dark decay variations, photosensitive members that have poor background potential characteristics are also unacceptable or require expensive and sophisticated control systems or trained repair persons to alter machine operating parameters. Inadequate compensation of background potential variations can cause copies to appear too light or too dark. In addition, such variations in background potential properties preclude optimization of background potential properties.

Control of both $V_{DDP}$ and $V_{BG}$ of photosensitive members is important not only initially but through the entire cycling life of the photosensitive members.

Thus, the characteristics of photosensitive members comprising a conductive layer and at least two electrically operative layers, one of which is a charge transport layer comprising a film forming resin and one or more aromatic amine compounds, exhibit deficiencies which are undesirable in high quality, high volume, high speed copiers, duplicators, and printers.

One technique to overcome the above described deficiencies was the development of a process for preparing an electrophotographic imaging member in which a photogenerating layer on a supporting substrate was coated with a charge transport layer forming mixture, the charge transport layer forming mixture comprising an aromatic amine compound of one or more compounds having the general formula:

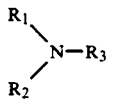

wherein $R_1$ and $R_2$ are an aromatic group selected from the group consisting of a substituted or unsubstituted phenyl group, naphthyl group, and polyphenyl group and $R_3$ is selected from the group consisting of a substituted or unsubstituted aryl group, alkyl group having from 1 to 18 carbon atoms and cycloaliphatic compounds having from 3 to 18 carbon atoms, a polymeric film forming resin in which the aromatic amine is soluble, a solvent such as methylene chloride for the polymeric film forming resin, and from about 1 part per million to about 10,000 parts per million, based on the weight of the aromatic amine compound, of a protonic acid or Lewis acid having a boiling point preferably greater than about 40° C. and soluble in the solvent. This process is disclosed in U.S. Pat. No. 4,725,518 to Kathleen M. Carmichael et al on Feb. 16, 1988, the entire disclosure of this patent being incorporated herein by reference. Although excellent results are achieved with the process of the invention described in U.S. Pat. No. 4,725,518, difficulties have been encountered in continuous manufacturing processes where long lengths of webs are coated at high speeds. More specifically, when a large production run of a multilayered photoreceptor is prepared by coating, most of the layers are applied sequentially in a continuous process which can include the application, for example, of a charge generating layer followed by drying the layer and the subsequent application of charge transport layer followed by further drying. Since the electrical properties of the final coated photoreceptor web can vary along its length during the coating operation due to various factors such as compositional changes in the charge generating layer coating mixture and the charge transport layer coating mixture as these coating mixtures are replenished during long coating runs, the electrical properties of the photoreceptor are tested after drying of the final coating while the coating run is in progress. Thus, if the electrical properties are unsatisfactory due to effects caused by changes in the electrical properties of the deposited and dried charge generating layer, the composition of the charge transport layer must be changed to compensate for the changes in the charge generating layer to achieve the desired electrical properties in the final photoreceptor product. Further, as the charge transport coating materials are replenished during a coating run, variations in the electrical properties along the length of the final dried transport layer can also affect the electrical properties of the final photoreceptor product. Since the charge transport layer is normally the last layer to be applied to a multilayered photoreceptor, alterations of the chemical composition of the charge transport layer immediately prior to coating can provide some control during the coating process to achieve the desired uniformity of electrophotographic performance notwithstanding variations in the electrical properties of the charge generating layer as it is being applied. Thus, if the electrical performance of a coated web after the transport layer emerges from a drying station is unsatisfactory, the entire coating line must be stopped and the concentration of the protonic acid or Lewis acid additive in the charge transport layer coating composition altered, for example, by adding additional additive and stirring it into the coating solution. Unfortunately, substantial time is required to achieve a uniform mixture of the additive dispersed throughout the charge transport solution. This is partly due to the high viscosity of the charge transport solution, e.g. 800 cp, and the large volume of coating solution utilized compared relative to the extremely small amount of additive added. Nonuniform mixtures cause still more variations in the electrical properties of the final photoreceptor product. Thus, the entire coating line may be shut down for as long as, for example, two hours while the additive is stirred into the viscous charge transport coating mixture. Moreover, in large production runs where the distances between the supply roll for the web and the location of the testing station downstream of the charge transport layer drying station losses can be very high, e.g., as much 600 feet of coated web have had to be scrapped. Moreover, in order to start up the line again and attain proper coating speed and to adjust the coating stations to achieve the desired mixture concentrations and uniformity, as much as an additional 1000 feet of coated web may be lost. This large loss of material involves not only the web substrate, but also all the other materials applied to the substrate. In addition, it has been found to be very difficult to determine the exact amount of additive to be added to achieve the desired final electrical properties because of the very small amounts utilized, e.g. 20 ppm, of the additive. Also, as described previously, alterations of the composition of the generator layer coating material as it is replenished can require further changes to the composition of the charge transport layer. Thus, for practical reasons, wide variations in the electrical properties of the final photoreceptor must be accepted. These wide variations in the electrical properties require complex designs in the charging, exposure, and development stations in modern, sophisticated high speed copiers, duplicators and printers to compensate for these variations so that high quality images can be produced.

Although the charge transport layer could be formulated by mixing metered amounts of material from two different sources of charge transporting coating compositions having two different concentrations of additive, mixing of the two compositions would still require considerable time which affects the amount of unacceptable coated photoreceptor material fabricated on the fly during the mixing process. Also, if mixing is accomplished during long runs, large amounts of material are also lost during cleaning of the mixing system.

INFORMATION DISCLOSURE STATEMENT

U.S. Pat. No. 3,888,465 issued to Terwilliger et al. on Jun. 10, 1975—An apparatus is disclosed in which an emulsion and an addenda sensitizer solution are directed as separate flows to a common junction where the flows are intermixed into a common flow upon coming into contact. The common flow of the emulsion and addenda sensitizer solution is then moved through an extended path which includes means for heating the emulsion to a predetermined temperature and maintaining it at said temperature for a predetermined period of time and means for cooling the common flow very rapidly, thereby finishing the emulsion and providing an emulsion of uniform sensitization. While the emulsion is being moved through the conduit which forms and defines the extended path, it is being mixed continuously by a series of elements arranged within and throughout the length of the conduit from the common junction to an outlet located beyond the cooling means. The emulsion and addenda sensitizer may be pumped with the aid of gear pumps. The conduit forming the extended path may be provided with a series of metal strips which have been twisted to an angle of about 180°. These strips facilitate mixing and heat transfer. The emulsion sensitization can be monitored by a liquid emulsion sensitometer and the degree of chemical sensitization can be controlled by a suitable feedback system to produce the desired photographic characteristics. The feedback system would be one in which the pumps are electrically controlled to get the desired flow rate at a specific emulsion chemical sensitizer flow rate ratio in accordance with the emulsion characteristics to ensure the proper combination of emulsion to chemical sensitizer level.

U.S. Pat. No. 4,725,518 to A. Carmichael et al. on Feb. 16, 1988—A process is disclosed for preparing an electrophotographic imaging member comprising applying a charge transport layer forming mixture to a photogenerating layer on a supporting substrate, the charge transport layer comprising a charge transporting aromatic amine compound, a polymeric film forming resin in which the aromatic amine is soluble, solvent for the polymeric film forming resin, and from about 1 ppm to about 10,000 ppm based on the weight of the aromatic amine of a protonic acid or Lewis acid having a bounding point greater than about 40° C. and soluble in the solvent. Because the protonic acid or Lewis acid added to the charge transport layer coating mixture is employed in parts per million quantities, it is preferred to mix the acid dopant with a relatively large amount of methylene chloride to form a master batch and thereafter combining an appropriate amount of acid doped methylene chloride from the master batch with the other charge transport layer coating mixture components. Thus, for example, the master batch can be prepared, for example, by initially preparing a 0.5% by weight solution of acid dopant in the methylene chloride and therefore after diluting with additional methylene chloride.

U.S. Pat. No. 4,543,314 issued to Maxwell on Sep. 24, 1985—A process is disclosed for the preparation of an electrostatographic photosensitive device comprising combining a sodium additive with trigonal solinum particles, an organic resin binder and a solvent for the binder to form a milling mixture and milling the milling mixture to form a uniform dispersion and applying the dispersion to a substrate to form a layer and drying the layer.

U.S. Pat. No. 4,874,682 issued to Scott et al. on Oct. 17, 1989—An organic photoconductor is disclosed in which a charge transport layer comprising acidic protons is reduced by a nonvolatile basic amine soluble in a common solvent. The nonvolatile basic amine can be either monomeric or polymeric.

U.S. Pat. No. 4,106,934 issued to Ternblom on Aug. 15, 1978—A photoconductive insulating composition is disclosed containing (a) one or more p-type organic photoconductor components and (b) a charge transfer complex of one or more electron acceptor components and one or more electron donor components, the electron donor components being selected from materials having certain fused ring structure. The composition may be included in both single layer photoconductive compositions or multilayer photoconductive compositions.

U.S. Pat. No. 4,264,695 issued to Kozima et al. on Apr. 28, 1981—A photosensitive material for use in electrophotography is disclosed comprising a conductive support, first layer consisting essentially of a substance capable of generating a conductive carrier through light absorption and an electron donor or electron acceptor, and the second layer consisting essentially of an electron acceptor or an electron donor, to wit a substance constituting the opposite party of the electron donor or the electron acceptor contained in the first layer.

U.S. Pat. No. 4,018,602 issued to Chu on Apr. 19, 1977—A method is disclosed for in situ preparation of photoconductive composites having an electronically active hole transport layer, and electronically active electron transport layer and a layer of charge transfer complex sandwiched there between. More specifically, a film containing either an electron donor or an electron acceptor is initially formed directly on a supportive conductive substrate. After this film has set, a second film is solvent coated on the previously formed film. The solvent used in preparation of the second film causes softening of the previously formed layer which permits interaction of an electron acceptor or electron donor in the casting solvent with an electron acceptor or electron donor of the previously formed layer, thereby forming charge transfer complex at the interface of these two films.

Thus, there is a need for a system which can provide rapid adjustment of the electrical properties of a photoreceptor during fabrication to more closely achieve a predetermined electrical property. Photoreceptors from large runs or from different runs that consistently meet very precise standards in electrical properties allows simplification of the devices in high speed copiers, duplicators and printers which previously had to compensate for wide fluctuations in electrical properties from photoreceptor to photoreceptor sourced from the same or different production runs.

SUMMARY OF THE INVENTION

It is, therefore, an object of the present invention to provide an improved photoreceptor fabrication system which overcomes the above-noted disadvantages.

It is yet another object of the present invention to provide an improved photoreceptor fabrication system which rapidly adjusts electrical properties of a charge transport layer to achieve a predetermined final electrical property for the entire final photoreceptor.

It is still another object of the present invention to provide an improved photoreceptor fabrication system which permits rapid adjustments while the fabrication process is in progress.

It is another object of the present invention to provide an improved photoreceptor fabrication system which reduces the amount of photoreceptor waste during fabrication.

It is yet another object of the present invention to provide an improved photoreceptor fabrication system which meets narrower tolerances in electrophotographic properties.

The foregoing objects and others are accomplished in accordance with this invention by providing processes and apparatus for fabricating an electrophotographic imaging member in which a web coated with a charge generation layer is coated with a charge transport layer comprising a dopant, the improvement comprising detecting the change in dopant concentration required, determining the amount of highly doped charge transport composition and amount of undoped or lowly doped charge transport composition required to achieve the change in dopant concentration, feeding the determined amounts of highly doped charge transport composition and undoped or lowly doped charge transport composition into a mixing zone, rapidly mixing the amounts of highly doped charge transport composition and undoped or lowly doped charge transport composition to form a uniformly doped charge transport composition, and applying the uniformly doped charge transport composition to the charge generation layer.

BRIEF DESCRIPTION OF THE DRAWINGS

A more complete understanding of the process and device of the present invention can be obtained by reference to the accompanying drawings wherein:

With reference to FIG. 1, a first solution vessel 10 is employed to contain a first solution of a charge transport coating composition having a high concentration of dopant. The first solution is fed through delivery valve 12 to a junction 14 by means of a first positive displacement metering pump 16 driven by variable speed electric motor 18 through suitable gears 20. Recirculation of the first solution is controlled by valve 22. A second solution vessel 24 is employed to contain a second solution of a charge transport coating composition having a low concentration of dopant or no dopant. The concentration of dopant in either the first solution or the second solution must be different from the other. The second solution is fed through delivery valve 26 to junction 14 by means of a second positive displacement metering pump 28 driven by variable speed electric motor 30 through suitable gears 32. Recirculation of the second solution is controlled by valve 34.

After the solutions are combined at junction 14, the combined solutions are rapidly and thoroughly mixed in mixer 36. The mixed solutions emerging from mixer 36 are fed to a suitable and conventional coating applicator (not shown) through an optional filter 38. Mixer 36 should rapidly mix the solutions in the shortest possible time and in the shortest possible distance. Such mixing is preferably accomplished at ambient room temperature.

Mixer 36 is preferably a small static mixer comprising a straight tube containing baffles such as a spiral baffle along its short length. For example, a two foot long tube having a spiral element (not shown) comprising 18 spirals achieves complete physical mixing of the first and second solutions. The introduction of acid through the blending system of this invention can be very short and can take effect, for example, in less than two hundred feet.

Figure 2:
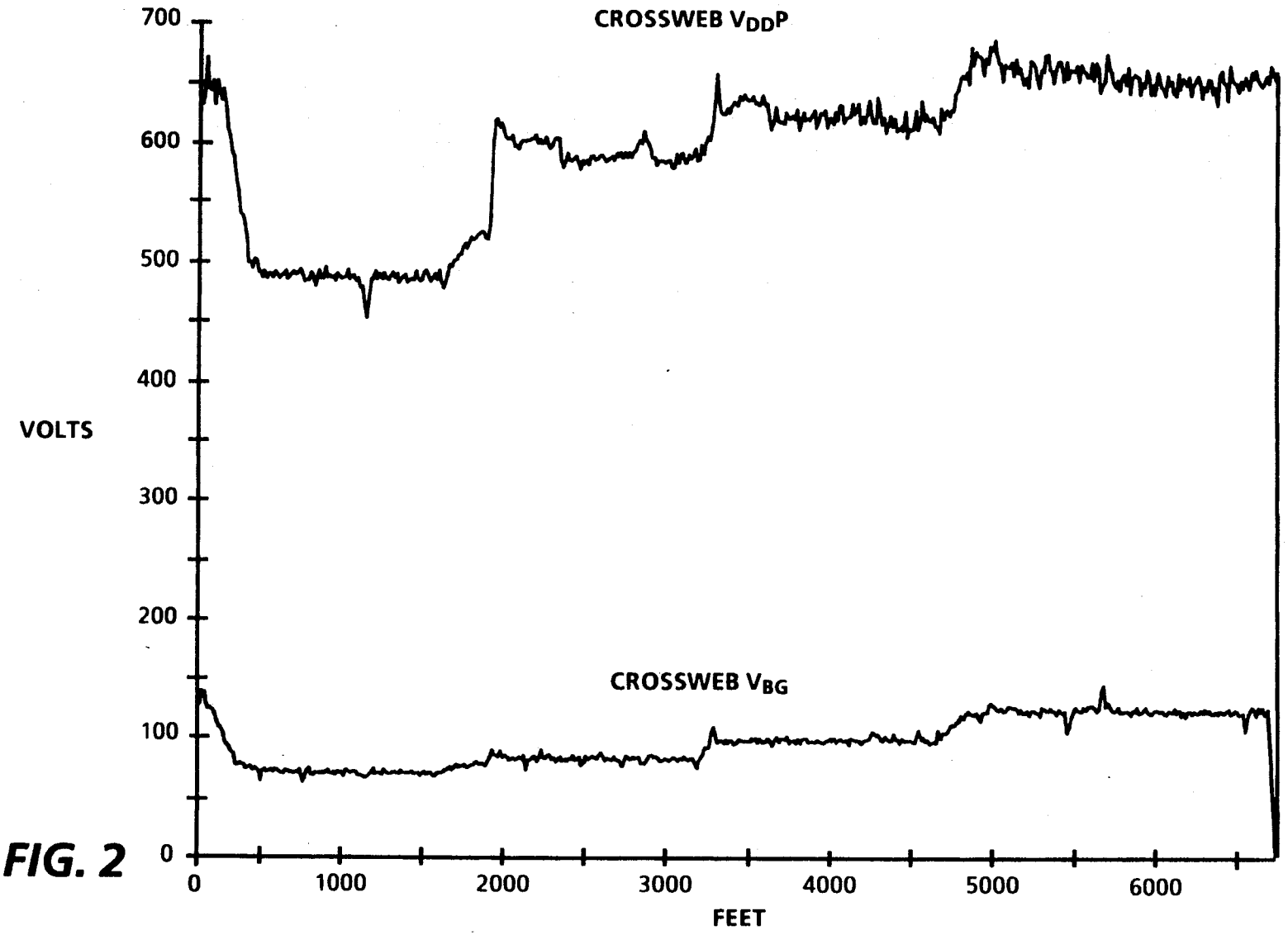
FIG. 2 graphically illustrates voltage potential ($V_{DDP}$) and ($V_{BG}$) characteristics across the web versus web length of a photosensitive member having two electrically operative layers on a conductive layer.

Referring to FIG. 2, the background potential ($V_{DDP}$) and ($V_{BG}$) characteristics across the web versus the web length of a photosensitive member having two electrically operative layers on a conductive layer are graphically shown. The steps in the FIG. 2 graph represent the rapid changes achieved by the doping techniques of this invention in less than about 200 feet. This rapid change results in a significant reduction of out of specification material that must be scrapped.

The system of this invention allows one to vary electrical response of photoreceptors directly on-line while the photoreceptors are being coated. No large storage pots of material are used for blending and large quantities of coating materials are avoided. Moreover, a very short mixing cycle with direct feed to coating applicators are achieved with the process of this invention.

The $V_{DDP}$ and $V_{BG}$ of the final dried photoreceptor web can be monitored by any suitable device. A typical monitoring device comprises a corotron charging device to charge the photoreceptor, a discharging lamp to discharge the photoreceptor and an electrometer to detect dark decay and background potentials. The degree of doping can be controlled by a suitable feed back system to produce the desired electrophotographic characteristics. The feed back system may, for example, be one in which the pumps 16 and 28 are electrically controlled to give the desired flow rate at a specific highly doped to undoped or lowly doped charge transport coating solution flow rate ratio in accordance with the calculated characteristics desired, thereby ensuring the proper combination of highly doped to undoped or lowly doped charge transport coating solution level.

As indicated previously, significantly less control and uniformity is achieved when a single charge transport coating solution vessel is utilized. This is because it is difficult to achieve an exact uniform concentration of dopant in large lots. The high viscosity of the coating solution, the low concentration of additive, the extensive time involved in uniform dispersion or solution and the fact that the concentration might be affected by evaporation loss of solvent and the like all work against achieving an exact uniform concentration of dopant in large lots.

In operation, the system of this invention involves the feeding of both a highly doped charge transport coating solution from first solution vessel 10 and an undoped (or one having a low concentration of dopant) charge transport coating solution from second solution vessel 24 into static mixer 36. Any suitable vessels 10 and 24 may be utilized to store the highly doped charge transport solution or the diluted or undoped charge transport solution. Generally, the vessels are closed during use to prevent contamination and are composed of a material which is chemically inert with respect to the components of the containing solutions. Typical vessels are constructed from stainless steel, glass lined steel, Teflon® lined steel and the like.

The coating solutions are pumped as two separate streams by two separate positive displacement metering pumps 16 and 28 and are combined at junction 14. The two separate positive displacement metering pumps 16 and 28 are preferably of the same size and are preferably computer controlled to regulate the amount of coating solution that is supplied from first solution vessel 10 and second solution vessel 24 into static mixer 36. Any suitable positive displacement metering pump may be utilized. Typical positive displacement metering pumps include diaphragm pumps, piston pumps, peristaltic pumps, gear pumps and the like. A preferred metering pump is a gear type pump because of the precise metering that can be achieved. Gear type pumps are also preferred because little slippage (back leakage) is encountered. Gear pumps are commercially available and can be obtained, for example, from Zenith Division of Parker Hannifin Corporation. The size of the pumps utilized depends upon the volume rate desired. Volume rate depends upon web speed, coating thickness and other predetermined factors. The metering pumps may be directly or indirectly driven by the variable speed motors 18 and 30. Variable speed direct current motors 18 and 30 directly coupled with pumps 16 and 28 are preferred for optimum control and accurate metering. Any suitable detection device (not shown) may be utilized to monitor the speed of the motors. Magnetic pickups are typical devices for determining revolutions per minute.

The coating solutions pumped by the two separate positive displacement metering pumps 16 and 28 into junction 14 are thereafter mixed together in a suitable mixer means 36. Typical mixer means 36 include pot type vessels with stirrers such as propellers, paddles, and turbines static mixing pipes, high shear agitators and the like. Optimum results are achieved with a static mixing pipe 36 which comprises a cylindrical housing containing internal baffles (not shown). The baffles may be of any suitable such as in the shape of spirals, partitions and the like. Static mixing pipes are preferred because the devices are easily degasified, mix materials in a very short distance, do not introduce bubbles into the coating mixture, and are easy to clean. Generally, mixing devices that introduce bubbles are to be avoided because the entrained bubbles will cause defects in the final dried coating. Another reason for preferring static mixing pipes is the relatively small volume material present in the device which reduces loss when the device is cleaned. Also, purging may be readily accomplished merely by inclining the mixing pipe. Further, mixing is effected at an extremely rapid rate so that mixing can be accomplished without shutting down the entire coating apparatus. In other words, mixing can be accomplished on-line and the mixed material may be utilized immediately after mixing. More specifically, with static mixing pipes, only small volumes of material are mixed at any given moment in time, mixing is accomplished extremely rapidly and only a small amount of material is lost during cleaning. A preferred static mixer 36 is short, e.g. two feet long, and comprises a baffle element (not shown), e.g. a baffle with 18 spirals which ensures complete mixing of the two coating solutions. Static mixers are well known and are commercially available, e.g. model 1.5-30-431-8, available from Chemineer and the like. Generally, the pressure between the metering pump and the mixing pipe is less than about 100 pounds per square inch. Pressures exceeding the 100 pounds per square inch tend to increase back slip where material pours backward through the metering pumps thereby rendering the metering of coating material less precise. Satisfactory results may be achieved when mixing is substantially complete within a distance of about 200 cm and in less than about 120 seconds in the mixing pipe. Preferably, mixing should be complete within a distance of about 150 cm and in less than about 60 seconds with optimum results being achieved when substantially complete mixing is accomplished in a distance of less than about 50 centimeters and in less that about 20 seconds in the mixing pipe. When mixing is not substantially complete within a distance of about 200 cm and in less than about 120 seconds in the mixing pipe, the amount out of specification material that must be scrapped approaches unduly high levels.

If desired, an optional filter 38 may be installed between the static mixer and coating die. Any suitable filter may be employed. Preferably, the filter is an absolute filter. Typical filters include those fabricated from sintered metal, sintered ceramics and the like. If desired, one or more filters may be utilized elsewhere in the system to filter the coating solutions.

Any suitable die (not shown) may be utilized to apply the charge transport coating mixture supplied from mixer 36. Extrusion dies are well known in the art. For example, extrusion dies are described in U.S. Pat. No. 4,521,457, this patent being incorporated herein by reference in its entirety. If desired, other suitable coating applicators may be substituted for the extrusion die. Typical coating applicators include direct gravure, Mayer rod coaters, reverse roll coaters, offset gravure and the like.

The electrical properties of the final photoreceptor are tested on-line downstream of the charge transport layer dryer (not shown). The tester (not shown) comprises a corotron charging device to charge the photoreceptor, a discharge lamp to discharge the photoreceptor, an electrometer to detect dark decay and background potential. The rate at which pumps 16 and 28 for first and second vessels 10 and 24, respectively, are operated may be controlled manually or be a computer. Generally, computer control is preferred because of the reduced reaction time in making the speed changes to the pumps. $V_{DDP}$ and $V_{BG}$ information is sent to a computer by suitable wiring and the computer compares the final photoreceptor values to predetermined target values and then through suitable algorithms sets the relationships of pumps 16 and 28 to maintain thickness and target Vddp and Vbg. Any suitable computer may be utilized to control the pump speeds. A typical computer is a model D3 Distributed Control System available from Texas Instruments. This is master computer that may be accessed from more than one location. The computer is programmed to perform calculations in any suitable manner to control pumps 16 and 28. The program can for example, perform the following calculations.

CALCULATIONS

The definition of the factors employed in the following calculations are:

A = Overall pump speed desired.
B = Doping level target.
C = High doping level-first solution vessel 11.
D = Low doping level-second vessel 24.
X = Pump ratio-first gear pump 16.
Y = Pump ratio-second gear pump 28.

$$X+Y=1 \quad (1)$$

$$CX+DY=B \quad (2)$$

Solve equation (2) for X:

$$X = \frac{(B - DY)}{C}$$

Use X in Equation (1) and solve for Y:

$$\frac{(B - DY)}{C} + Y = 1$$

$$Y(C - D) = (C - B)$$

$$Y = \frac{(C - B)}{(C - D)}$$

Use Y in equation (1) to solve for X:

$$X = 1 - \frac{(C - B)}{(C - D)}$$

These calculations involve two simultaneous equations calculated at the same time. Although a distributor control system is preferred, other devices such as a PLC controller can be employed instead of a distributed control system. Any suitable software may be utilized. The language may be in BASIC, Boolean Logic, C-Level and the like. The system of this invention also enables experimental doping runs of high precision for the development of multilayered photoreceptor coating processes.

The computer may also be programmed to allow manual intervention whereby the operator may compensate for thickness differences in the charge generator layer and charge transport layer during the coating operation. Moreover, a closed loop system may be utilized to automatically compensate for differences or changes in the thickness of the coatings.

As an illustration, if the coating solution in first solution vessel 10 is doped with 20 ppm (parts per million dopant) and the coating solution in second solution vessel 24 is doped with 0.0 ppm dopant and the required dopant level in the final mixture is 10 ppm, both metering gear pumps 16 and 28 would be run to produce the same output to provide a coating solution doped with 10 ppm dopant as it emerges from static mixer 36 and is transported to a coating applicator (not shown) such as an extrusion die at a coater head. Thus, for example, assuming that a coating of a 24 micrometers thick (after drying) charge transport layer on a web having a width of about 75 cm is desired, a total combined metering gear pump output of 50 revolutions per minute would be required for the specific equipment employed. If 10 ppm is the desired dopant level in the final solution, as described above, each pump, 16 and 28, would turn at 25 rpm. If 5 ppm of dopant is required in the final solution, the pump for the vessel supplying the undoped coating solution would turn at 37.5 rpm. Because any suitable computer may be used to control pumps 16 and 28, the combined pump speed can easily be adjusted by a one "button" on an operator control monitor at the coater. In other words, the activation of the calculation algorithms within the computer system can be by means of operator intervention using preprogrammed function buttons. Activation of the button allows the operator to adjust the $V_{DDP}$ and $V_{BG}$ values from the on-line tester downstream of the charge transport layer dryer and compare them against specified target values. The system then outputs pump 16 and 28 speeds to achieve the electrical target while also maintaining overall pumping speed labeled A in the above calculations which is programmed to achieve a certain target thickness for the coating.

Generally, an electrophotoconductive member prepared with the process of this invention comprises two electrically operative layers on a supporting substrate. The substrate may be opaque or substantially transparent and may comprise numerous suitable materials having the required mechanical properties.

A conductive layer or ground plane which may comprise the entire supporting substrate or be present as a coating on an underlying member may comprise any suitable material including, for example, aluminum, titanium, nickel, chromium, brass, gold, stainless steel, carbon black, graphite and the like. The conductive layer may vary in thickness over substantially wide ranges depending on the desired use of the electrophotoconductive member. Accordingly, the conductive layer can generally range in thickness of from about 50 Angstrom units to many centimeters. Since a flexible photoresponsive imaging device is desired, the thickness is usually between about 100 Angstrom units to about 750 Angstrom units. The underlying member may be of any conventional material including metal, plastics and the like. Typical underlying members include insulating non-conducting materials comprising various resins known for this purpose including polyesters, polycarbonates, polyamides, polyurethanes, and the like. The coated or uncoated supporting substrate is flexible and may have any number of many different final configurations such as, for example, a sheet, a scroll, an endless flexible belt, and the like. Preferably, the insulating substrate is in the form of an endless flexible belt and comprises a commercially available polyethylene terephthalate polyester known as Mylar available from E. I. duPont de Nemours & Co.

If desired, any suitable blocking layer may be interposed between the conductive layer and the charge generating layer. A preferred blocking layer comprises a reaction product between a hydrolyzed silane and a metal oxide layer of a conductive anode, the hydrolyzed silane having the general formula:

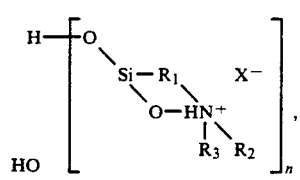

I or

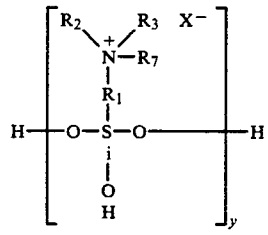

II or mixtures thereof, wherein $R_1$ is an alkylidene group containing 1 to 20 carbon atoms, $R_2$, $R_3$ and $R_7$ are independently selected from the group consisting of H, a lower alkyl group containing 1 to 3 carbon atoms and a phenyl group, X is a hydroxyl group or an anion of an acid or acidic salt, n is 1, 2, 3 or 4, and y is 1, 2, 3 or 4.

The imaging member is prepared by depositing on the metal oxide layer of a metallic conductive anode layer a coating of an aqueous solution of the hydrolyzed silane at a pH between about 4 and about 10, drying the reaction product layer to form a siloxane film and applying the generating layer and charge transport layer to the siloxane film. Typical hydrolyzable silanes include 3-aminopropyl triethoxy silane, (N,N'-dimethyl 3-amino)-propyl triethoxysilane, N,N-dimethylamino phenyl triethoxy silane, N-phenyl aminopropyl trimethoxy silane, trimethoxy silylpropyldiethylene triamine and mixtures thereof.

After drying, the siloxane reaction product film formed from the hydrolyzed silane contains larger molecules in which n is equal to or greater than 6. The reaction product of the hydrolyzed silane may be linear, partially crosslinked, a dimer, a trimer, and the like. Optimum reaction product layers are achieved with hydrolyzed silane solutions having a pH between about 7 and about 8, because inhibition of cycling-up and cycling-down characteristics of the resulting treated photoreceptor are maximized. Some tolerable cycling-down has been observed with hydrolyzed amino silane solutions having a pH less than about 4.

Control of the pH of the hydrolyzed silane solution may be effected with any suitable organic or inorganic acid or acidic salt. Typical organic and inorganic acids and acidic salts include acetic acid, citric acid, formic acid, hydrogen iodide, phosphoric acid, ammonium chloride, hydrofluorsilicic acid, Bromocresol Green, Bromophenol Blue, p-toluene sulfonic acid and the like.

Any suitable technique may be utilized to apply the hydrolyzed silane solution to the metal oxide layer of a metallic conductive anode layer. Typical application techniques include spraying, dip coating, roll coating, wire wound rod coating, extrusion die coating and the like. Although it is preferred that the aqueous solution of hydrolyzed silane be prepared prior to application to the metal oxide layer, one may apply the silane directly to the metal oxide layer and hydrolyze the silane in situ by treating the deposited silane coating with water vapor to form a hydrolyzed silane solution on the surface of the metal oxide layer in the pH range described above. The water vapor may be in the form of steam or humid air. Generally, satisfactory results may be achieved when the reaction product of the hydrolyzed silane and metal oxide layer forms a layer having a thickness between about 20 Angstroms and about 2,000 Angstroms. As the reaction product layer becomes thinner, cycling instability begins to increase. As the thickness of the reaction product layer increases, the reaction product layer becomes more non-conducting and residual charge tends to increase because of trapping of electrons and thicker reaction product films tend to become brittle prior to the point where increases in residual charges become unacceptable. A brittle coating is, of course, not suitable for flexible photoreceptors, particularly in high speed, high volume copiers, duplicators and printers.

Drying or curing of the hydrolyzed silane upon the metal oxide layer should be conducted at a temperature greater than about room temperature to provide a reaction product layer having more uniform electrical properties, more complete conversion of the hydrolyzed silane to siloxanes and less unreacted silanol. Generally, a reaction temperature between about 100° C. and about 150° C. is preferred for maximum stabilization of electrochemical properties. The temperature selected depends to some extent on the specific metal oxide layer utilized and is limited by the temperature sensitivity of the substrate. Reaction product layers having optimum electrochemical stability are obtained when reactions are conducted at temperatures of about 135° C. The reaction temperature may be maintained by any suitable technique such as ovens, forced air ovens, radiant heat lamps, and the like. For practical purposes, sufficient crosslinking is achieved by the time the reaction product layer is dry provided that the pH of the aqueous solution is maintained between about 4 and about 10.

One may readily determine whether sufficient condensation and crosslinking has occurred to form a siloxane reaction product film having stable electric chemical properties in a machine environment by merely washing the siloxane reaction product film with water, toluene, tetrahydrofuran, methylene chloride or cyclohexanone and examining the washed siloxane reaction product film to compare infrared absorption of Si—O— wavelength bands between about 1,000 to about 1,200 $cm^{-1}$. If the Si—O— wavelength bands are visible, the degree of reaction is sufficient, i.e. sufficient condensation and cross-linking has occurred, if peaks in the bands do not diminish from one infrared absorption test to the next. It is believed that the partially polymerized reaction product contains siloxane and silanol moieties in the same molecule. The expression "partially polymerized" is used because total polymerization is normally not achievable even under the most severe drying or curing conditions. The hydrolyzed silane appears to react with metal hydroxide molecules in the pores of the metal oxide layer. This siloxane coating is described in U.S. Pat. No. 4,464,450 to L. Teuscher, the disclosure of this patent being incorporated herein in its entirety.

In some cases, intermediate layers between the blocking layer and the adjacent charge generating or photogenerating material may be desired to improve adhesion or to act as an electrical barrier layer. If such layers are utilized, they have a dry thickness between about 0.01 micron to about 5 microns. Typical adhesive layers include film-forming polymers such as polyester, polyvinylbutyral, polyvinylpyrolidone, polyurethane, polymethyl methacrylate and the like.

Any suitable charge generating or photogenerating material may be employed in one of the two electrically operative layers in the multilayer photoconductor prepared by the process of this invention. Typical charge generating materials include metal free phthalocyanine described in U.S. Pat. No. 3,357,989, metal phthalocyanines such as copper phthalocyanine, quinacridones available from DuPont under the tradename Monastral Red, Monastral Violet and Monastral Red Y, substituted 2,4-diamino-triazines disclosed in U.S. Pat. No. 3,442,781, and polynuclear aromatic quinones available from Allied Chemical Corporation under the tradename Indofast Double Scarlet, Indofast Violet Lake B, Indofast Brilliant Scarlet and Indofast Orange. Other examples of charge generator layers are disclosed in U.S. Pat. Nos. 4,265,990, 4,233,384, 4,306,008, 4,299,897, 4,232,102, 4,233,383, 4,415,639 and 4,439,507. The disclosures of these patents are incorporated herein in their entirety.

Any suitable inactive resin binder material may be employed in the charge generator layer. Typical organic resinous binders include polycarbonates, acrylate polymers, vinyl polymers, cellulose polymers, polyesters, polysiloxanes, polyamides, polyurethanes, epoxies, and the like. Many organic resinous binders are disclosed, for example, in U.S. Pat. Nos. 3,121,006 and 4,439,507, the entire disclosures of which are incorporated herein by reference. Organic resinous polymers may be block, random or alternating copolymers.

The photogenerating layer containing photoconductive compositions and/or pigments, and the resinous binder material generally ranges in thickness of from about 0.1 micrometer to about 5.0 micrometers, and preferably has a thickness of from about 0.3 micrometer to about 3 micrometers. Thicknesses from about 0.1 micrometer to about 10 micrometers outside these ranges can be selected providing the objectives of the present invention are achieved.

The photogenerating composition or pigment is present in the resinous binder composition in various amounts, generally, however, from about 5 percent by volume to about 60 percent by volume of the photogenerating pigment is dispersed in about 40 percent by volume to about 95 percent by volume of polyvinyl carbazole or the poly(hydroxyether) binder, and preferably from about 7 percent to about 30 percent by volume of the photogenerating pigment is dispersed in from about 70 percent by volume to about 93 percent by volume of the polyvinyl carbazole or poly(hydroxyether) binder composition. The specific proportions selected depends to some extent on the thickness of the generator layer.

Other typical photoconductive layers include amorphous or alloys of selenium such as selenium-arsenic, selenium-tellurium-arsenic, and selenium-tellurium.

Any suitable and conventional technique may be utilized to mix and thereafter apply the photogenerating layer coating mixture. Typical application techniques include spraying, dip coating, roll coating, wire wound rod coating, extrusion die coating and the like. Drying of the deposited coating may be effected by any suitable conventional technique such as oven drying, infra red radiation drying, air drying and the like.

The final dried transport layer employed in the electrically operative charge transport layer in the multilayer photoconductor prepared by the process of this invention comprises about 25 to about 75 percent by weight of at least one charge transporting aromatic amine compound, about 75 to about 25 percent by weight of an polymeric film forming resin in which the aromatic amine is soluble, and about 1 to about 10,000 parts per million based on the weight of the aromatic amine of protonic acid or Lewis acid soluble in a suitable solvent such as methylene chloride.

The aromatic amine compound may be of one or more compounds having the general formula:

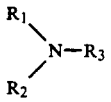

wherein $R_1$ and $R_2$ are an aromatic group selected from the group consisting of a substituted or unsubstituted phenyl group, naphthyl group, and polyphenyl group and $R_3$ is selected from the group consisting of a substituted or unsubstituted aryl group, alkyl group having from 1 to 18 carbon atoms and cycloaliphatic compounds having from 3 to 18 carbon atoms. The substituents should be free form electron withdrawing groups such as $NO_2$ groups, CN groups, and the like. Typical aromatic amine compounds that are represented by this structural formula include:

I. Triphenyl amines such as:

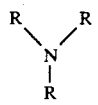

II. Bis and poly triarylamines such as:

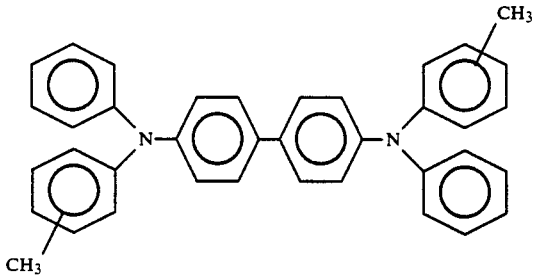

III. Bis arylamine ethers such as:

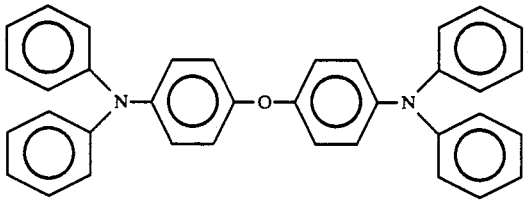

IV. Bis alkyl-arylamines such as:

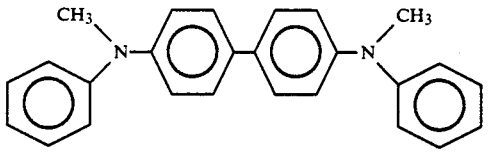

A preferred aromatic amine compound has the general formula:

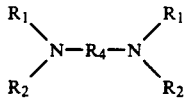

wherein $R_1$, and $R_2$ are defined above and $R_4$ is selected from the group consisting of a substituted or unsubstituted biphenyl group, diphenyl ether group, alkyl group having from 1 to 18 carbon atoms, and cycloaliphatic group having from 3 to 12 carbon atoms. The substituents should be free form electron withdrawing groups such as $NO_2$ groups, CN groups, and the like.

Excellent results in controlling dark decay and background voltage effects have been achieved when the imaging members doped in accordance with this invention comprising a charge generation layer comprise a layer of photoconductive material and a contiguous charge transport layer of a polycarbonate resin material having a molecular weight of from about 20,000 to about 120,000 having dispersed therein from about 25 to about 75 percent by weight of one or more compounds having the general formula:

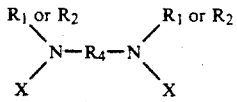

wherein $R_1$, $R_2$, and $R_4$ are defined above and X is selected from the group consisting of an alkyl group having from 1 to about 4 carbon atoms and chlorine, the photoconductive layer exhibiting the capability of photogeneration of holes and injection of the holes and the charge transport layer being substantially non-absorbing in the spectral region at which the photoconductive layer generates and injects photogenerated holes but being capable of supporting the injection of photogenerated holes from the photoconductive layer and transporting the holes through the charge transport layer.

Examples of charge transporting aromatic amines represented by the structural formulae above for charge transport layers capable of supporting the injection of photogenerated holes of a charge generating layer and transporting the holes through the charge transport layer include triphenylmethane, bis(4-diethylamine-2-methylphenyl) phenylmethane; 4',4''-bis(diethylamino)-2',2''-dimethyltriphenyl-methane,N,N'-bis(alkylphenyl)-[1,1'-biphenyl]-4,4'-diamine wherein the alkyl is, for example, methyl, ethyl, propyl, n-butyl, etc., N,N'-diphenyl-N,N'-bis(chlorophenyl)-[1,1'-biphenyl]-4,4'-diamine, N,N'-diphenyl-N,N'-bis(3''-methylphenyl)-(1,1'-biphenyl)-4,4'-diamine, and the like dispersed in an inactive resin binder.

Any suitable inactive resin binder soluble in methylene chloride or other suitable solvent may be employed in the process of this invention. Typical inactive resin binders soluble in methylene chloride include polycarbonate resin, polyvinylcarbazole, polyester, polyarylate, polyacrylate, polyether, polysulfone, and the like. Molecular weights can vary from about 20,000 to about 1,500,000.

Any suitable stable protonic acid or Lewis acid or mixture thereof soluble in methylene chloride or other suitable solvent may be employed as a dopant in the transport layer of this invention to control dark decay and background potential. Stable protonic acids and Lewis acids do not decompose or form a gas at the temperatures and conditions employed in the preparation and use of the final multilayer photoconductor. Thus, protonic acids and Lewis acids having a boiling point greater than about 40° C. are especially preferred for greater stability during storage, transportation and operating conditions. Protonic acids generally are acids in which a proton ($H^{30}$) is available. Organic protonic acids include, for example, those having the following structural formulae:

$R_5$—COOH wherein $R_5$ is H or a substituted or unsubstituted alkyl group containing from 1 to 12 carbon atoms;

$R_6$—$SO_3H$ wherein $R_6$ is substituted or unsubstituted alkyl or aryl group containing from 1 to 18 carbon atoms;

$R_7$—COOH wherein $R_7$ is a substituted or unsubstituted cycloaliphatic or cycloaliphatic-aromatic group containing from 4 to 12 carbon atoms;

$R_8$—$SO_2H$ wherein $R_8$ is a substituted or unsubstituted alkyl, aryl, cycloalkyl group containing from 1 to about 12 carbon atoms; and

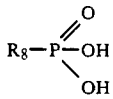

Typical organic protonic acids represented by these formulas having a boiling point greater than about 40° C. and that are soluble in methylene chloride or other suitable solvent include trifluoroacetic acid, trichloroacetic acid, methane sulfonic acid, acetic acid, nitrobenzoic acid, benzene-sulfonic acid, benzene-phosphonic acid, trifluoro methane sulfonic acid, and the like and mixtures thereof. Optimum results are achieved with trifluoroacetic acid and trichloroacetic acid because of good solubility, acid strength and in case of $CF_3COOH$ good chemical stability. Inorganic protonic acids include halogen, sulfur, selenium tellurium or phosphorous containing inorganic acids. Typical inorganic protonic acids include $H_2SO_4$, $H_3PO_4$, $H_2SeO_3$, $H_2SeO_4$. Other less preferred inorganic protonic acids having boiling point less than 40° C. include HCl, HBr, HI, and the like and mixtures thereof.

Lewis acids generally are electron acceptor acids which can combine with another molecule or ion by forming a covalent chemical bond with two electrons from the second molecule or ion. Typical Lewis acids include aluminum trichloride, Ferric trichloride, stannic tetrachloride, boron trifluoride, $ZnCl_2$, $TiCl_4$, $SbCl_5$, $CuCl_2$, $SbF_5$, $VCl_4$, $TaCl_5$, $ZrCl_4$, and the like and mixtures thereof. The protonic acids and Lewis acids should preferably have a boiling point greater than about 40° C. to avoid loss of the acid dopant during preparation, storage, transportation or use at higher temperatures. Acids of lower boiling points than 40° C. may be used where practical.

Methylene chloride solvent is a desirable component of the charge transport layer coating mixture for adequate dissolving of all the components and for its low boiling point. As described in U.S. Pat. No. 4,725,518, acid impurities in methylene chloride solvent dramatically affect the dark decay and dark discharge characteristics of the final multilayer photoconductor. Since the relative amounts of acid impurities vary from one batch of methylene chloride solvent to another, the dark decay and dark discharge characteristics of the final multilayer photoconductor vary from one production run to another. Moreover, the effect of extremely slight changes in acid content on dark decay and dark discharge characteristics of the final multilayer photoconductor are most pronounced in the range of about 0 to about 10 and greater than 100 parts per million based on the weight of the methylene chloride solvent. Since batch to batch fluctuations in the relative quantities of acid impurities in commercially available methylene chloride is extremely minute, it is virtually impossible to rapidly and accurately quantify the amount of acid impurities with conventional analytical techniques. Thus, even if one were somehow above to recognize that freezing the relative amount of acid impurities in methylene chloride would aid in predicting the dark decay and dark discharge characteristics of the final multilayer photoconductor, the normal batch to batch fluctuations in the relative quantities of acid impurities in commercially available methylene chloride and the normally inadequate techniques for determining the relative quantities of acid impurities would render such freezing impractical. Even if one were to discover the adverse effects of the acid impurities in methylene chloride and purified the solvent prior to use, acid impurities can form in the solvent after purification by mere exposure to air, moisture and/or light.

By adding to methylene chloride, to the aromatic amine, to the resin binder or to any combination of the transport layer components a controlled, predetermined amount of a protonic acid or Lewis acid having a boiling point greater than about 40° C. and soluble in methylene chloride, dark decay and dark discharge characteristics of the final multilayer photoconductor is controlled in the process of U.S. Pat. No. 4,725,518 even when the methylene chloride contains batch to batch differences in the amount of acid impurities prior to the addition of the predetermined amount of protonic acid or Lewis acid. By merely adding a sufficient predetermined amount of protonic acid or Lewis acid to the methylene chloride, to the aromatic amine, to the resin binder or to any combination of the transport layer components, the dark decay and dark discharge characteristics of the final multilayer photoconductor can be made to increase rapidly, level off and remain fairly constant up to about 100 ppm as described in detail in U.S. Pat. No. 4,725,518. Rapid increase in dark decay occurs thereafter with a resultant $V_{DDP}$ loss. Thus, the dark decay and dark discharge characteristics of the final multilayer photoconductor can be accurately predicted and controlled even when the exact quantity of minor amounts of acid in the starting methylene chloride batch is unknown. Satisfactory results may be achieved with the technique of U.S. Pat. No. 4,725,518 when from about 0.1 part per million to about 1000 parts per million protonic acid or Lewis acid, based on the weight of the methylene chloride, is used to prepare the charge transport coating mixture. The optimum acid concentration depends on the strength of the acid used. When using the amount of charge transporting amine as a basis for determining the amount acid concentration to employ, the optimum acid concentration for the system of U.S. Pat. No. 4,725,518 is between 1 ppm to 10,000 ppm based on the weight of charge transporting amine used. When less than about 0.1 part per million protonic acid or Lewis acid based on the weight of the methylene chloride or less than 1 ppm protonic acid or Lewis acid based on the weight of charge transporting amine is employed, the final multilayer photoconductor possesses higher $V_{DDP}$ and $V_{BG}$. The 0.1 ppm based on the weight of the methylene chloride or 1 ppm protonic acid or Lewis acid based on the weight of charge transporting amine is the minimum acid quantity that has any significant effect. Since the amount of acid impurities in commercially available methylene chloride is normally less than about 5 parts per million based on the weight of the methylene chloride, it dramatically affects the reproducibility of the dark decay and dark discharge characteristics and background of the final multilayer photoconductor. With the technique of U.S. Pat. No. 4,725,518, the deliberate addition of a proper level of a predetermined amount of protonic acid or Lewis acid to the methylene chloride, to the aromatic amine, to the resin binder or to any combination of the transport layer components causes the dark decay and dark discharge characteristics of the final multilayer photoconductor to level off and remain fairly constant at a predictable value, assuming that the initial amount of acid impurity is in the 0–5 ppm range, correcting the erratic batch to batch fluctuations in the amount of acid impurities present in the methylene chloride employed to prepare the charge transport layer coating mixture. An amount of protonic acid or Lewis acid exceeding about 1000 parts per million, based on the weight of the methylene chloride, results in very high dark decay and low $V_{DDP}$. An amount of protonic acid or Lewis acid between about 1 part per million to about 50 parts per million protonic acid or Lewis acid, based on the weight of the methylene chloride, is preferred for the system of U.S. Pat. No. 4,725,518 because the desired photoreceptor properties remain fairly constant over this range of acid. The optimum amount of protonic acid or Lewis acid to be used within the ranges described above also depends to some extent upon the particular conductive electrode layer employed in the final multilayer photoconductor. Thus, the optimum amount of acid dopant for a multilayer photoconductor having a titanium conductive electrode layer is slightly different than the optimum amount of acid dopant for a multilayer photoconductor having an aluminum conductive electrode. Generally, because the protonic acid or Lewis acid added to the charge transport layer coating mixture is employed in parts per million quantities, it is preferred in the system of U.S. Pat. No. 4,725,518 to mix the acid dopant with a relatively large amount of methylene chloride to form a master batch and thereafter combine an appropriate amount of acid doped methylene chloride from the master batch with the other charge transport layer coating mixture components. The master batch used in the process of U.S. Pat. No. 4,725,518 can be prepared, for example, by initially preparing a 0.5 percent by weight solution of acid dopant in methylene chloride and thereafter diluting the solution with additional methylene chloride.

As described above and unlike the system of U.S. Pat. No. 4,725,518, the system of the instant invention involves the metered feeding of both a highly doped charge transport coating solution from a first solution vessel and an undoped (or one having a low concentration of dopant) charge transport coating solution from a second solution vessel into a mixer. The coating solutions are pumped as two separate streams by two separate positive displacement metering pumps, combined at a stream junction and thereafter uniformly mixed in the mixer. The two metering pumps are preferably of the same size and are preferably computer controlled to regulate the amount of coating solution that is supplied from the first solution vessel and second solution vessel into the mixer. The solution volume rate depends upon web speed, coating thickness and other predetermined factors. The metering pumps are driven by variable speed direct current motors for control and accurate metering.

Generally, the highly doped charge transport coating solution of this invention comprises between about 20 parts per million (ppm) and about 100 ppm of dopant based on the total weight of the charge transport layer coating solution for satisfactory results. A dopant concentration of between about 20 ppm and about 50 ppm is preferred and optimum results are achieved with a concentration of dopant of between about 20 ppm and about 30 ppm based on the total weight of the solution. The concentration of the dopant is preferably greater than about 20 ppm when the first and second solution vessels 24 and 10 are same size and the solutions in these vessels are to be consumed at a reasonable rate. Concentrations exceeding 100 ppm can cause corrosion if stainless steel equipment is employed. Satisfactory results are achieved when the concentration of the diluted or undoped charge transport solution in second solution vessel 24 is between about 0 ppm and about 7 ppm based on the total weight of the charge transport layer coating solution. A concentration between about 0 ppm and about 2 ppm is preferred and optimum results are achieved with a charge transport layer solution that is has no dopant deliberately added.

Generally, the rate at which charge transport layer coating material is pumped from the vessel containing highly doped coating material and from the vessel containing a low concentration of dopant or no dopant is preferably in a volume percent ratio of about 50:50. However, relative ratios may, if desired, be varied between about 20:1 and about 1:20. Ratios outside this range are less desirable because the vessel providing the larger amount will empty out too rapidly. Moreover, the high pump rate increases the pressure downstream of the pump so much that back leakage of the coating material through the pump can occur with a resultant loss of precise control over the metering.

If desired, the methylene chloride solvent employed in the process of this invention may be subjected to acid removal or neutralization treatments prior to acid doping. Also, if desired, the methylene chloride can be dried prior to acid doping. Furthermore, any formaldehyde which may be present and objectionable can be removed by a treatment with a suitable material such as sodium bisulfite. Any suitable technique may be utilized for such treatments. Typical acid removal or neutralization treatments include treatment with $K_2CO_3$, $CaCO_3$, $MgCO_3$, molecular sieve, ion exchange resins, and the like. Treatment by $K_2CO_3$, $NaHSO_3$ and molecular sieve is preferred because it removes acid, formaldehyde and water, respectively. When methylene chloride solvent is subjected to acid removal or a neutralization treatment without subsequent acid doping, the dark decay and dark discharge characteristics of the final multilayer photoconductor are unacceptably low, i.e. high $V_{DDP}$ and $V_{BG}$, for precision, high volume, high speed copiers, duplicators and printers.

Any suitable and conventional technique may be utilized to thereafter apply the charge transport layer mixture to the charge generating layer. Typical application techniques include spraying, dip coating, roll coating, wire wound rod coating, extrusion die coating and the like. Drying of the deposited coating may be effected by any suitable conventional technique such as oven drying, infra red radiation drying, air drying and the like. Generally, the thickness of the dried transport layer is between about 5 to about 100 microns, but thicknesses outside this range can also be used.

The dried charge transport layer should be an insulator to the extent that the electrostatic charge placed on the charge transport layer is not conducted in the absence of illumination at a rate sufficient to prevent formation and retention of an electrostatic latent image thereon. In general, the ratio of the thickness of the charge transport layer to the charge generator layer is preferably maintained from about 2:1 to 200:1 and in some instances as great as 400:1.

In some cases, intermediate layers between the blocking layer or conductive layer and the adjacent generator transport layer may be desired to improve adhesion or to act as an electrical barrier layer. If such layers are utilized, the layers preferably have a dry thickness between about 0.01 micron to about 0.1 microns. Typical adhesive layers include film-forming polymers such as polyester, polyvinylbutyral, polyvinylpyrolidone, polyurethane, polymethyl methacrylate and the like.

An apparatus is disclosed U.S. Pat. No. 3,888,465 issued to Terwilliger et al in which an emulsion and an addenda sensitizer solution are directed as separate flows to a common junction where the flows are intermixed into a common flow upon coming into contact. The common flow of the emulsion and addenda sensitizer solution is then moved through an extended path which includes means for heating the emulsion to a predetermined temperature and maintaining it at that temperature for a predetermined period of time and means for cooling the common flow very rapidly, thereby finishing the emulsion and providing an emulsion of uniform sensitization. While the emulsion is being moved through the conduit which forms and defines the extended path, it is being mixed continuously by a series of elements arranged within and throughout the length of the conduit from the common junction to an outlet located beyond the cooling means. The emulsion and addenda sensitizer may be pumped with the aid of gear pumps. The conduit forming the extended path may be provided with a series of metal strips which have been twisted to an angle of about 180°. These strips facilitate mixing and heat transfer. The emulsion sensitization can be monitored by a liquid emulsion sensitometer and the degree of chemical sensitization can be controlled by a suitable feedback system to produce the desired photographic characteristics. The feedback system would be one in which the pumps are electrically controlled to get the desired flow rate at a specific emulsion chemical sensitizer flow rate ratio in accordance with the emulsion characteristics to ensure the proper combination of emulsion to chemical sensitizer level. However, the system described by Terwilliger et al does not in any way pertain to electrophotographic imaging members. Moreover, since mixing and heat exchange in the system of U.S. Pat. No. 3,888,465 requires an extended path to heat and mix two agents and to react the materials, it is unrelated to short path mixing. Also, the large storage pot and large quantities of material mixed by Terwilliger et al are not capable of quickly responding to on-line changes in electrical properties of a product being coated.

Thus, the coating system of present invention provides an improved photoreceptor fabrication system which rapidly adjusts electrical properties of a charge transport layer to achieve a predetermined final electrical property for the entire final photoreceptor. Moreover, the fabrication system allows rapid adjustments while the fabrication process is in progress. Also, the amount of photoreceptor waste during fabrication is markedly reduced. In addition, the photoreceptor fabrication system of this invention which permits the achievement of narrower electrophotographic properties tolerances.

The invention will now be described in detail with respect to the specific preferred embodiments thereof along with a control example, it being understood that these examples are intended to be illustrative only and that the invention is not intended to be limited to the materials, conditions, process parameters and the like recited herein. All parts and percentages are by weight unless otherwise indicated.

EXAMPLE I

A flexible photoreceptor web was continuously coated on a coating line. The web being coated was polyester film vacuum coated with a titanium layer having a thickness of about 200 Angstroms and a width of about 75 cm. The exposed surface of the titanium layer was oxidized by exposure to oxygen in the ambient atmosphere prior to the application of subsequent coatings. A siloxane hole blocking layer was prepared by applying a 0.22 percent (0.001 mole) solution of 3-aminopropyl triethoxylsilane to the oxidized surface of the titanium layer with a gravure applicator. The deposited coating was dried at 135° C. in a forced air oven to form a layer having a thickness of about 450 Angstroms. An intermediate layer coating of polyester resin (49000, available from E.I. duPont de Nemours & Co.) was applied with a gravure applicator to the siloxane coated base. The polyester resin coating was dried in an oven to form a film having a thickness of about 0.05 micrometer. A slurry coating solution of 50 percent by weight sodium doped trigonal selenium having a particle size of about 0.05 micrometer to 0.2 micrometer and about 50 percent by weight of polyvinylcarbazole in a 50 percent:50 percent by weight mixture of tetrahydrofuran and toluene solvent was coated with an extrusion die applicator onto the polyester coating to form a layer having a wet thickness of 2.5 micrometers. The coated member was dried at 135° C. in a forced air oven to form a charge generation layer having a dry thickness of about 2.0 micrometers.

A charge transport layer was formed on the charge generator layer by applying a solution of a polycarbonate resin having a molecular weight from about 50,000 to about 100,000 (Makrolon, available from Farbenfabriken Bayer A. G.) and N,N'-diphenyl-N,N'-bis(3-methylphenyl)-[1,1'-biphenyl]-4,4'-diamine dissolved in methylene chloride to ultimately provide a 50 percent by weight loading of N,N'-diphenyl-N,N'-bis(3-methylphenyl)-[1,1'-biphenyl]-4,4'diamine in the dried transport layer. The charge transport coating solution was pumped from a single coating solution vessel using a Zenith pump through about 3.5 meters (12 feet) of 25.4 mm (1 in) inside diameter conduit to an extrusion die that spanned the width of the web and had a extrusion slot opening of about 254 micrometers (0.01 inch). The extrusion die was similar to the die described in U.S. Pat. No. 4,521,457. No on-line mixing device nor dual coating vessel, nor dual pumps were employed in the conduit forming the path between the single coating solution vessel and the extrusion die. The distance between the coating solution vessel and the extrusion die was 70 meters (220 feet). The transport layer was coated on top of the generator layer with the extrusion die applicator and dried at temperature of about 135° C. to form a 40 micrometer thick wet layer which upon oven drying formed a 24 micrometer thick dry hole transporting layer.

Since the electrical properties of the final coated photoreceptor web varies along its length during the coating operation due to various factors such as compositional changes in the charge generating layer coating mixture and the charge transport layer coating mixture as these coating mixtures are replenished during long coating runs, the electrical properties of the photoreceptor was tested after drying, of the final coating i.e. downstream of the charge transport layer drier, while the coating run was in progress. This testing was accomplished by negatively corona charged the photoreceptor in the dark to a development potential of about −800 volts. The charging current to the photoreceptor sample corotron was controlled by a Trek Coratrol Model 610B Power Supply. The photoreceptor was thereafter exposed to photodischarge levels ranging from 0 to 25 and finally erased by exposure to about 500 erg/cm$^2$. The $V_{DDP}$ and $V_{BG}$ were measured and plotted. The measurements were made with an electrostatic probe, adjacent to the photoreceptor and corotron, 0.7 second after charging. The probe was connected to a TREK Electrostatic Voltmeter Model 4600, the output of which was transmitted to a Graphic Recorder Model WR3101. The VDDP and VBG changed during the continuous coating operation from within specification to rejectable levels or from 500 volts Vddp to 720 volts Vddp and 80 volts Vbg to 140 volts Vbg. Since this change in electrical properties was unsatisfactory, the composition of the charge transport layer was changed to compensate for the undesirable changes and to achieve the desired electrical properties in the final photoreceptor product. The composition of the charge transport layer was changed by stopping the coating line, adding a calculated amount of acid dopant to the single coating solution vessel, mixing and recirculating the solution for two hours then testing by restarting the coating line. The entire coating line was stopped for the two hours to allow the concentration of the protonic acid additive in the charge transport layer coating composition to be altered by stirring in additional dopant acid or adding transport material with no dopant in it into the viscous charge transport coating solution in the single coating solution vessel storage vessel using a mechanical paddle stirrer. Because of the distance between the polyester web supply roll and the location of the testing station downstream of the charge transport layer drying station, scrapping of about 600 feet of coated web was necessary. Moreover, in order to start up the coating line again and attain proper coating speed and to adjust the coating stations to achieve the desired mixture concentrations and uniformity, an additional 1000 feet of coated web was lost.

EXAMPLE II

Figure 1:
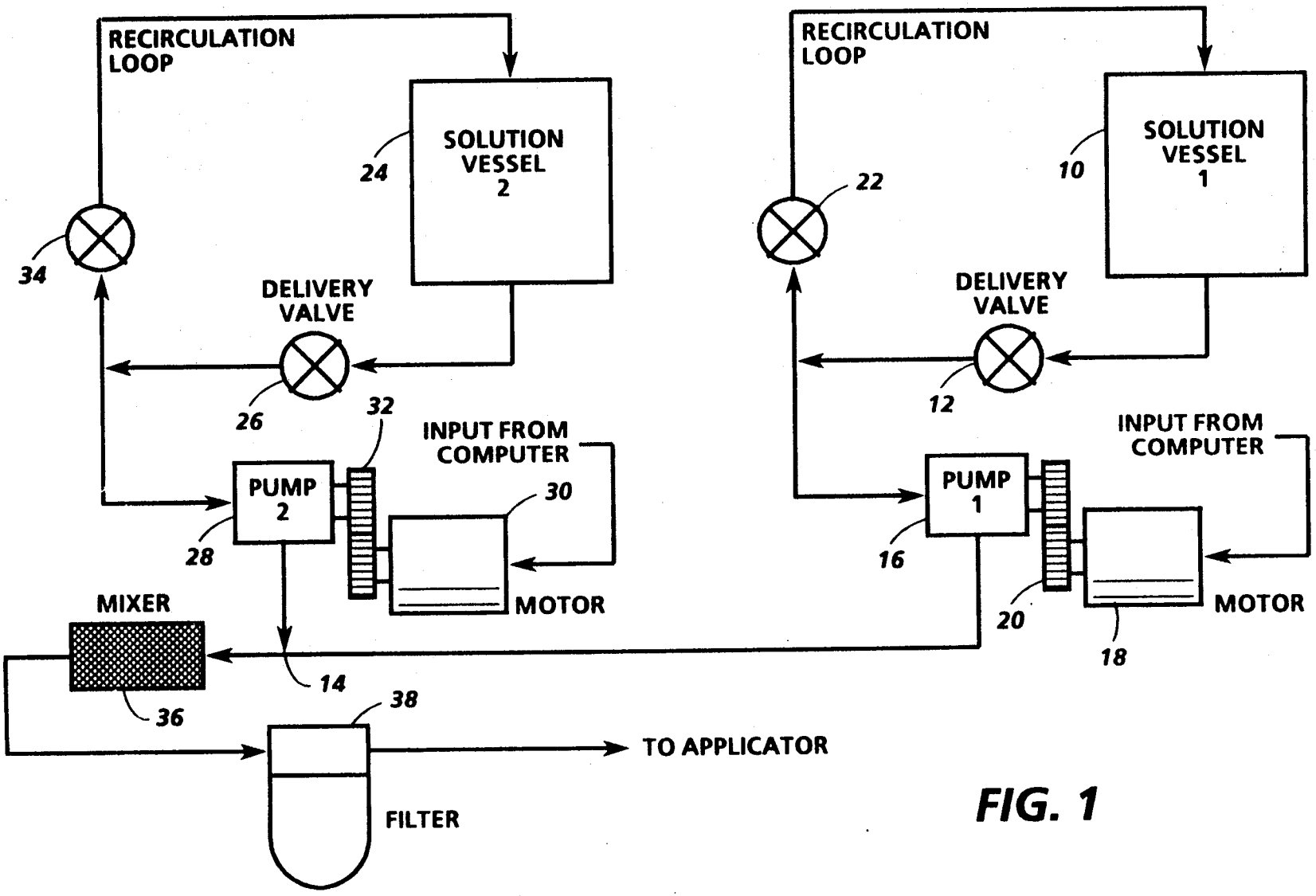
FIG. 1 is a schematic representation of apparatus for carrying out the process in accordance with the invention.

The process described in Example I was repeated with the same materials except that instead of shutting down the line when the photoreceptor electrical properties at the end of the coating line was found to be unacceptable, the charge transport coating mixture was changed using a system similar to that illustrated in FIG. 1. Both a highly doped charge transport coating solution from a first charge transport coating solution vessel and an undoped charge transport coating solution from a second solution vessel were fed through a static mixer (Model 1.5-30-431-8, available from Chemineer) to the extrusion die. The coating solutions were pumped as two separate streams by two separate positive displacement metering gear pumps (Model BLB-5456-50, available from Zenith). The two streams were subsequently combined at a junction. The two separate positive displacement metering pumps were of the same size and computer controlled to regulate the amount of coating solution that was supplied from the first solution vessel and second solution vessel into the static mixer. The metering pumps were directly driven by variable speed direct current motors. Magnetic pickups were utilized for determining revolutions per minute of the motors. The static mixer was a mixing pipe comprising a cylindrical housing 56 cm (22 inches) long containing an internal baffle with 18 spirals. The pressure between the metering pump and the mixing pipe was less than about 100 pounds per square inch. An absolute filter (Model SMX-040-H, available from Pall) was used between the static mixer and the extrusion die. Mixing of the solutions was accomplished on-line in the mixing pipe in 20 seconds and the mixed material was utilized immediately after mixing.

The electrical properties of the final photoreceptor were tested on-line downstream of the charge transport layer dryer as described in Example I. When the $V_{DDP}$ and $V_{BG}$ changed during the continuous coating operation the speed at which the gear pumps turned for the first and second vessels were changed by input from a computer (Model D/3, available from Texas Instruments). VDDP and VBG information was sent to the computer from the testing device by suitable wiring. The operator compared the final photoreceptor VDDP and VBG values to predetermined target values and then outputted the correct pump speeds to maintain the electrical targets as well as the preassigned thickness specifications. Complete mixing of the two coating solutions was effected at an extremely rapid rate to achieve the desired $V_{DDP}$ and $V_{BG}$ in the final dried photoreceptor without shutting down the entire coating line and scrapping of only about 150 feet of coated web was necessary.

Although the invention has been described with reference to specific preferred embodiments, it is not intended to be limited thereto, rather those skilled in the art will recognize that variations and modifications may be made therein which are within the spirit of the invention and within the scope of the claims.

What is claimed is:

1. A continuous coating process for fabricating an electrophotographic imaging member comprising a providing a substrate coated with a charge generation layer and applying a coating of a charge transport layer comprising a dopant, the improvement comprising detecting during said continuous coating process the change in dopant concentration required when the electrical properties of said imaging member deviate from a predetermined value, determining the amount of a highly doped charge transport coating solution and undoped or lowly doped charge transport composition required to achieve said change in dopant concentration, feeding said amounts of a highly doped charge transport composition and undoped or lowly doped charge transport composition into a mixing zone, rapidly mixing said amounts of a highly doped charge transport composition and undoped or lowly doped charge transport composition in said mixing zone to form a uniformly doped charge transport composition, and applying said uniformly doped charge transport composition to said charge generation layer during said continuous coating process.

2. A continuous coating process according to claim 1 including feeding said amounts of a highly doped charge transport composition and feeding said undoped or lowly doped charge transport composition into said mixing zone with gear pumps.

3. A continuous coating process according to claim 2 wherein said mixing zone comprises a static mixer.

4. A continuous coating process according to claim 2 including rapidly mixing said amounts of a highly doped charge transport composition and undoped or lowly doped charge transport composition in said mixing zone to form a uniformly doped charge transport composition in less than about 120 seconds.

5. A continuous coating process according to claim 2 including rapidly mixing said amounts of a highly doped charge transport composition and undoped or lowly doped charge transport composition in said mixing zone to form a uniformly doped charge transport composition in less than about 60 seconds.

6. A continuous coating process according to claim 2 including rapidly mixing said amounts of a highly doped charge transport composition and undoped or lowly doped charge transport composition in said mixing zone to form a uniformly doped charge transport composition in a distance of less than about 200 centimeters.

7. A continuous coating process according to claim 2 including rapidly mixing said amounts of a highly doped charge transport composition and undoped or lowly doped charge transport composition in said mixing zone to form a uniformly doped charge transport composition in a distance of less than about 150 centimeters.

8. A continuous coating process according to claim 2 including applying said uniformly doped charge transport composition to said charge generation layer with an extrusion die.

9. A continuous coating process according to claim 2 including drying said uniformly doped charge transport composition after it is applied to said charge generation layer, detecting deviation of dark decay and background potential of said electrophotographic imaging member from a predetermined value, and determining the change in dopant concentration required to achieve said change in dopant concentration.

10. A continuous coating process according to claim 2 wherein said highly doped charge transport coating solution and undoped or lowly doped charge transport composition each comprise a film forming polymer and a charge transporting aromatic amine compound may be of one or more compounds having the general formula:

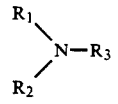

wherein $R_1$ and $R_2$ are an aromatic group selected from from the group consisting of a substituted or unsubstituted phenyl group, naphthyl group, and polyphenyl group and $R_3$ is selected from the group consisting of a substituted or unsubstituted aryl group, alkyl group having from 1 to 18 carbon atoms and cycloaliphatic compounds having from 3 to 18 carbon atoms.

11. A continuous coating process according to claim 2 wherein said highly doped charge transport coating solution comprises a film forming polymer, a charge transporting aromatic amine compound and between about 20 parts per million and about 100 ppm of dopant based on the total weight of said highly doped charge transport coating solution and said undoped or lowly doped charge transport composition comprises a film forming polymer, an aromatic amine compound and between about 0 parts per million and about 7 ppm of dopant based on the total weight of said undoped or lowly charge transport coating solution.

12. A continuous coating process according to claim 11 wherein said dopant is a solvent soluble, stable protonic acid or Lewis acid or mixture thereof.

13. A continuous coating process according to claim 12 wherein said protonic acid is selected from the group consisting of trifluoroacetic acid, trichloroacetic acid, acetic acid and mixtures thereof.

14. A continuous coating process according to claim 11 wherein said substrate coated with said charge generation layer comprises flexible polymer web, a metal oxide layer of a conductive anode and a blocking layer interposed between said metal oxide layer and said photogenerating layer.

15. A continuous coating process according to claim 2 including feeding said amounts of a highly doped charge transport composition and feeding said undoped or lowly doped charge transport composition into said mixing zone at a relative ratio between about 20:1 and about 1:20.

* * * * *